US008672000B2

(12) United States Patent
Pritchard

(10) Patent No.: US 8,672,000 B2
(45) Date of Patent: Mar. 18, 2014

(54) PACKAGE SYSTEM WITH AUTOMATIC SHUT-OFF VALVE FOR USE WITH DISPENSING DEVICES

(75) Inventor: Barry Pritchard, Nazareth, PA (US)

(73) Assignee: Fres-co System USA, Inc., Telford, PA (US)

( * ) Notice: Subject to any disclaimer, the term of this patent is extended or adjusted under 35 U.S.C. 154(b) by 379 days.

(21) Appl. No.: 13/231,260

(22) Filed: Sep. 13, 2011

(65) Prior Publication Data

US 2012/0067458 A1 Mar. 22, 2012

Related U.S. Application Data

(60) Provisional application No. 61/383,542, filed on Sep. 16, 2010.

(51) Int. Cl.
*B65B 3/04* (2006.01)

(52) U.S. Cl.
USPC ..... 141/384; 141/348; 141/392; 137/247.15

(58) Field of Classification Search
USPC ..... 141/348, 383–386, 392; 137/247.13, 137/247.15, 247.21, 247.23
See application file for complete search history.

(56) References Cited

U.S. PATENT DOCUMENTS

| | | | | |
|---|---|---|---|---|
| 4,492,249 | A * | 1/1985 | Arino et al. | 137/515 |
| 4,957,220 | A * | 9/1990 | Du | 222/66 |
| 5,255,713 | A | 10/1993 | Scholle et al. | |
| 5,353,836 | A * | 10/1994 | deCler et al. | 137/614.05 |
| 5,775,364 | A * | 7/1998 | Erb | 137/322 |
| 5,901,761 | A * | 5/1999 | Rutter et al. | 141/346 |
| 6,347,785 | B1 * | 2/2002 | Copp et al. | 251/149.6 |
| 6,612,344 | B2 * | 9/2003 | Nagel et al. | 141/7 |
| 6,637,725 | B2 * | 10/2003 | Davis et al. | 251/149.6 |
| 7,246,721 | B2 | 7/2007 | Pritchard | |
| 7,487,951 | B2 * | 2/2009 | Johnson | 251/149.1 |
| 8,196,621 | B2 * | 6/2012 | Johnson | 141/372 |
| 8,430,125 | B2 * | 4/2013 | Massie et al. | 137/613 |
| 2002/0179875 | A1 * | 12/2002 | Davis et al. | 251/149.6 |
| 2003/0034084 | A1 * | 2/2003 | Nagel et al. | 141/7 |
| 2008/0053568 | A1 * | 3/2008 | Johnson | 141/383 |
| 2010/0187230 | A1 * | 7/2010 | Beer et al. | 220/89.1 |

FOREIGN PATENT DOCUMENTS

| | | | |
|---|---|---|---|
| FR | 2742207 | A1 | 6/1997 |
| GB | 2101702 | A | 1/1983 |
| GB | 2341852 | A | 3/2000 |

OTHER PUBLICATIONS

International Search Report for PCT/US2011/051530 mailed Dec. 22, 2011.

* cited by examiner

*Primary Examiner* — Gregory Huson
*Assistant Examiner* — Nicolas A Arnett
(74) *Attorney, Agent, or Firm* — Caesar, Rivise, Bernstein, Cohen & Pokotilow, Ltd.

(57) ABSTRACT

A package system for dispensing a flowable material into a conduit of a dispensing apparatus. The package system includes a package and a connector. The package, e.g., a bag-in-box, comprises a hollow bag and a tap fitment for enabling the contents of the bag to flow out when the fitment is open. The connector includes an automatic shut off valve and is arranged to be fixedly secured to the conduit of the dispensing apparatus and releasably secured to the fitment. The valve is arranged to enable the flow of flowable material from the package into the conduit when the fitment is open, while preventing any of that material from flowing out of the conduit when the connector is disconnected from the fitment.

14 Claims, 2 Drawing Sheets

PACKAGE SYSTEM WITH AUTOMATIC SHUT-OFF VALVE FOR USE WITH DISPENSING DEVICES

CROSS-REFERENCE TO RELATED APPLICATIONS

This application claims priority from Provisional Application Ser. No. 61/383,542, filed on Sep. 16, 2010, entitled Package System With Automatic Shut-Off For Use With Dispensing Devices, which application is assigned to the same assignee as this application and whose disclosure is incorporated by reference herein.

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISK

Not Applicable

BACKGROUND OF THE INVENTION

This invention relates to flexible packages and more particularly to flexible package systems for use with dispensing apparatus, e.g., beverage making machines, for dispensing flowable materials.

Various soft-drink making/dispensing apparatus today make use of what is referred to as "bag-in-box" packages for holding the drink-making ingredient, e.g., syrup. In particular, the bag-in-box package includes an outer protective container (the "box") and an inner flexible material container (the "bag"). The outlet of the package is typically in the form of a fitment, e.g., a tap, which mounted on a portion of the wall of the flexible package and is in fluid communication with its interior. The tap is normally closed to prevent the flowable material for accidentally leaking out of the package, e.g., when the package is stored or in transport. When the package is ready to be used it is placed within the beverage making apparatus and its tap is connected to a flexible pipe or conduit (hereinafter referred to as the "pump conduit") which forms the input to the pumping mechanism of the dispensing apparatus. The tap can then be opened, whereupon when the dispensing apparatus is actuated to produce a beverage its pumping mechanism applies suction to the conduit to pump a desired quantity of the beverage-making ingredient, e.g., the syrup, for mixing with carbonated water or some other liquid.

When all of the available contents of the package have been dispensed, the tap is closed to prevent any residual flowable material from leaking out of the tap during removal of the package from the dispensing apparatus. A new package can then be introduced into the dispensing apparatus and its tap connected to the pump conduit. Once that has been accomplished the tap can be opened to enable the contents of the package to be dispensed by the dispensing apparatus.

As will be appreciated by those skilled in the art, after the package has been removed from the dispensing apparatus some residual beverage making ingredient, e.g., syrup, may still be resident in the pump conduit and, if so, could leak out the disconnected end (i.e., the end which had been connected to the tap). Such action presents a problem in keeping the dispensing apparatus sanitary (e.g., residual syrup on portions of the dispensing apparatus could serve as a source of bacterial contamination).

The subject invention addresses that problem by providing a packaging system including a flexible package, a tap and a connector. The connector is arranged to effect the automatic closure of the input end of the pump conduit when it is disconnected from the package's tap.

SUMMARY OF THE INVENTION

One aspect of this invention entails a package system for enabling the dispensing a flowable material, e.g., syrup, therefrom into a conduit of a dispensing apparatus, e.g., a soft drink making machine. The package comprises a hollow body and a fitment. The fitment is arranged to be opened to enable the flowable material to flow out of the package. The connector includes an automatic shut off valve, e.g., a spring-biased ball valve or an umbrella valve, and is arranged to be fixedly secured to the conduit of the dispensing apparatus and releasably secured to the fitment. The automatic shut off valve is arranged to enable the flow of flowable material from the package into the conduit when the connector is secured to the fitment and the fitment is open, but prevents any flowable material in the conduit from flowing out of the conduit when the connector is disconnected from the fitment.

Another aspect of this invention entails a conduit assembly for connection to a package containing a flowable material located in a dispensing apparatus. The flexible package includes a fitment to which the conduit assembly is arranged to be releasably secured. The fitment is arranged to be opened to enable the flowable material to flow out of the package. The conduit assembly comprises a conduit and a connector including an automatic shut off valve. The connector is arranged to be releasably secured to the fitment. The automatic shut off valve, e.g., a spring-biased ball valve or an umbrella valve, is arranged to enable the flow of flowable material from the package into the conduit when the connector is secured to the fitment and the fitment is open, but prevents any liquid in the conduit from flowing out of the conduit when said connector is disconnected from the fitment.

DETAILED DESCRIPTION OF THE PREFERRED EMBODIMENT

Figure 1:
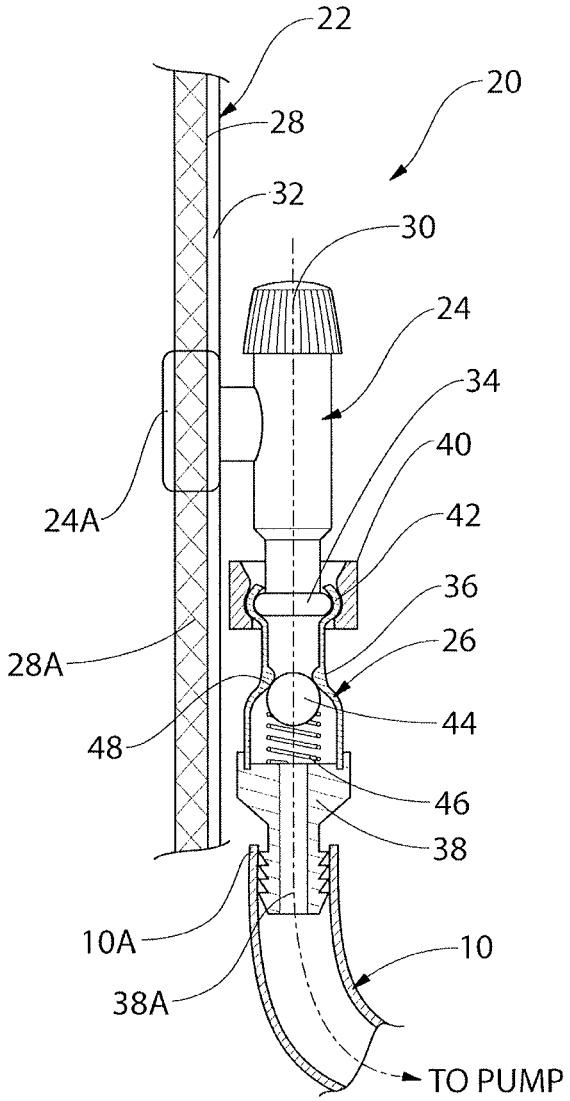
FIG. 1 is a side elevation view, partially in section, showing one embodiment of a package system constructed in accordance with this invention, the system including a flexible package in which a flowable material is located, and a tap fitment to which a connector of a conduit assembly is arranged to be releasably secure to enable a flowable material to be drawn from the package.

Referring now to the various figures of the drawing wherein like reference characters refer to like parts, there is shown in FIG. 1 an exemplary embodiment of a package system 20 constructed in accordance with this invention. The system 20 basically comprises a bag-in-box package 22 including a tap fitment 24 and a connector 26. The bag-in-box package can be of any suitable construction. One particularly suitable construction is like that shown and claimed in my published application US2005/0211726, now U.S. Pat. No. 7,246,721, whose disclosure is incorporated by reference herein.

Thus, as can be seen in FIG. 1, the bag-in-box package basically comprises a bag 28 formed of a flexible material and the tap fitment 24. The fitment has a generally boat shaped base section 24A sealed between contiguous wall portions 28A of the bag 28. The tap fitment includes an internal valve (not shown) and a cap 30 coupled to the valve, so that when the cap is twisted, e.g., rotated ¼ turn or 90 degrees, it opens the internal valve to enable liquid, e.g., syrup, within the package to be dispensed, when rotated in the opposite direction the internal valve is closed. The flexible bag 28 is itself located within an outer protective carton or container 32, with a portion of the fitment extending out of the carton. In the exemplary embodiment shown the tip of the tap fitment is in the form of a rounded lip 34.

That tap fitment 24 is arranged to be releasably connected to the inlet end 10A of a conduit 10. The conduit 10 serves as the heretofore discussed "pump conduit". To that end, the opposite end of the conduit 10 is connected to the pump mechanism (not shown) of the dispensing apparatus, e.g., a soft-drink making/dispensing machine, so that when the pump is operated suction is applied via the pump conduit to draw the flowable materials from the package via the opened tap fitment.

Figure 2:
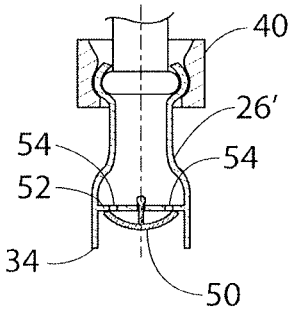
FIG. 2 is a side elevation view, partially in section, showing an alternative embodiment of the connector of the package system of this invention.

The connector 26 of the system 20 is fixedly secured to the inlet end 10A of the pump conduit 10 and serves to releasably connect the tap fitment 24 to the pump conduit. One embodiment of the connector 26 is shown in FIG. 1 and another embodiment, designated as connector 26', is shown in FIG. 2. In either case the connector basically comprises a tubular body member 36, a first coupling 38 and a second coupling 40. As stated above, those components are fixedly secured to the inlet end 10A of the pump conduit 10, so that they remain with the pump conduit when the bag-in-box package 22 is disconnected from the pump conduit. The tubular body member 36 includes an automatic shut-off valve (to be described in detail later).

The lower end of the tubular body member is connected to the inlet end of the pump conduit 10 by use of the coupling 38. That coupling is in the form of a tubular plug having a ridged lower end 38A arranged to be fixedly received within the internal passageway of the pump conduit 10. The upper end of the coupling 38 is fixedly secured to the lower end of the tubular body member 36.

The upper end of the tubular body member 36 includes an annular recess 42 arranged to receive the lip 34 of the tap fitment 24. The coupling 40 is in the form of a sleeve or collar surrounding the annular recess 42 in the tubular body member 36. The collar 40 is arranged to be snap-fit over the upper portion of the tubular body member 36 to constrict its upper end about the lip of the tap and thereby form a fluid tight interface between the tap 24 and the tubular body member 36.

Figure 3:
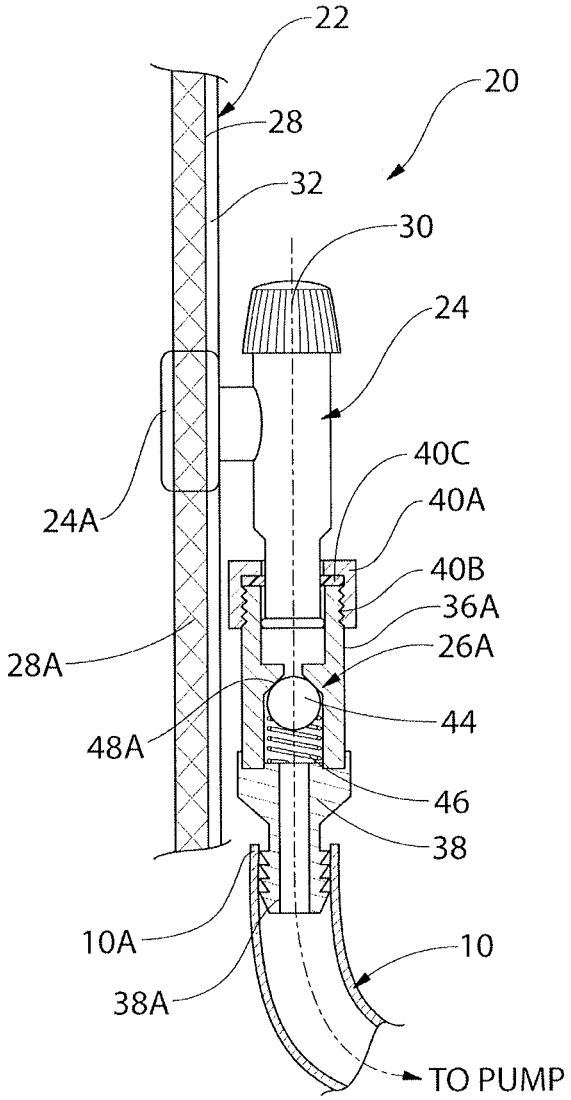
FIG. 3 is a side elevation view of an alternative embodiment of a connector of the conduit assembly and which is arranged to be connected to the tap fitment.

It should be pointed out at this juncture that the collar for connecting the connector to the fitment 24 can be constructed as so that instead of snap fitting over the upper end of the tubular body member it is in the form of threaded collar. That alternative arrangement is shown in FIG. 3. Thus as can be seen, a threaded collar 40A is arranged to be threadedly received on external threads 40B extending about the tubular body member 36A of an alternative embodiment connector 26A. A resilient gasket 40C is located within the threaded collar 40A and is arranged so that when the threaded collar 40A is screwed tightly into engagement with the tubular body member 36A, the gasket 40C is squeezed radially inward, thereby forming a fluid tight interface between the connector 26A and the fitment 24.

The automatic shut-off valve included in the embodiment of the connector 26 shown in FIG. 1 is in the form of a ball 44, which is biased by a compression spring 46 into engagement with a valve seat 48 projecting inward from the wall of the tubular body member 36. In a similar manner, the embodiment of connector 26A shown in FIG. 3 includes a ball 44, which is biased by a compression spring 46 into engagement with a valve seat 48A projecting inward from the wall of the tubular body member 36A. In both embodiments, the spring 46 is located between the ball and a portion of the coupling 38. The bias established by the spring is set so that when the tap fitment is open and the pump of the dispensing apparatus operated, the flow of liquid from the tap moves the ball 44 off of the seat 48, whereupon the liquid is pumped from the package for mixture with the other beverage making ingredient, e.g., carbonated water, to make the soft drink. Alternatively, the tap fitment 24 may include a pin or other projection (not shown) which engages the ball 44 to move it off of the valve seat 48 against the bias of the spring 46 when the connector 26 is secured to the fitment. In such a case, the automatic valve will be open irrespective of whether or not the tap fitment is open (i.e., turned on).

Irrespective of how the ball is moved off of the valve seat (e.g., whether as a result of the suction caused by the operation of the pump or as a result of the connection of the connector to the tap fitment) when the connector 26 is disconnected from the tap fitting 24, the ball will return to its normally biased state in engagement with the valve seat. Thus, any liquid which may at this time be in the pump conduit 10 cannot exit through the end 10A since the valve will now be shut.

In FIG. 2 an alternative embodiment of the automatic shut off valve is shown. That valve basically comprises an umbrella member 50 formed of a flexible, resilient material, e.g., rubber, and is seated in a valve seat 52 extending inward from the wall forming the tubular body member 36. The valve seat includes plural apertures 54 therein. The umbrella member is normally biased so that its periphery is in engagement with the valve seat and covering the apertures 54, but moves off of the valve seat to expose the apertures upon the flow of liquid from the tap fitment 24 so that the liquid can flow through those apertures. Disconnection of the connector from the tap fitment also results in the automatic closure of that valve so that any liquid which may be in the pump conduit cannot exit from it.

Like the embodiment of the automatic shut off valve of FIG. 1, the automatic shut off valve of FIG. 2 can also be arranged so that the valve is opened by use of a pin or other projection engaging it when the connector is secured to the tap fitting.

Irrespective of how the automatic shut off valve is constructed or how it its operated, the flexible pumping conduit can be detached from the tap, e.g., pulled off, with the shut-off valve operating to automatically stop any reverse flow from the connector tube to prevent drips and back-flow.

It should be pointed out at this juncture that other types of automatic shut off valves can be used in lieu of the two specific examples shown and described herein. Moreover, the subject invention is not limited to bag-in-box applications, but can be used with any flexible package holding a flowable material which is dispensed via a tap or other similar type fitment.

Without further elaboration the foregoing will so fully illustrate my invention that others may, by applying current or future knowledge, adopt the same for use under various conditions of service.

I claim:

1. A package system for enabling the dispensing a flowable material therefrom into a conduit of a dispensing apparatus, the dispensing apparatus including a pump to which the conduit is connected and which produces suction in the conduit when the pump is operated, said package system comprising a package and a connector, said package comprising a hollow body and a fitment, said fitment being arranged to be opened to enable said flowable material to flow out of said package, said connector including an automatic shut off valve and being arranged to be fixedly secured to the conduit of the dispensing apparatus and releasably secured to said fitment, said automatic shut off valve being arranged to enable the flow of flowable material from said package into the conduit when said connector is secured to said fitment and said fitment is open, but preventing any flowable material in the conduit from flowing out of the conduit when said connector is disconnected from the fitment, said automatic shut off valve being arranged to open in automatic response to suction in the conduit.

2. The package system of claim 1 wherein said automatic shut off valve comprises a ball valve.

3. The package system of claim 1 wherein said automatic shut off valve comprises an umbrella valve.

4. The package system of claim 1 additionally comprising a collar for releasably securing said connector to said fitment.

5. The package system of claim 4 wherein said collar is arranged to be snap-fit over said fitment and connector.

6. The package system of claim 4 wherein said collar is arranged to be threadedly engaged over said fitment and connector.

7. The package system of claim 1 wherein said package is in the form of a bag-in-box, wherein said hollow body comprises a flexible bag.

8. A conduit assembly for connection to a package containing a flowable material located in a dispensing apparatus, the flexible package including a fitment to which the conduit assembly is arranged to be releasably secured, the fitment being arranged to be opened to enable the flowable material to flow out of the package, said conduit assembly comprising a conduit and a connector including an automatic shut off valve, the dispensing apparatus including a pump to which said conduit is connected and which produces suction in said conduit when the pump is operated, said connector being arranged to be releasably secured to the fitment, said automatic shut off valve being arranged to enable the flow of flowable material from the package into said conduit when said connector is secured to the fitment and the fitment is open, but preventing any liquid in the conduit from flowing out of the conduit when said connector is disconnected from the fitment, said automatic shut off valve being arranged to open in automatic response to suction in said conduit.

9. The conduit assembly of claim 8 wherein said automatic shut off valve comprises a ball valve.

10. The conduit assembly of claim 8 wherein said automatic shut off valve comprises an umbrella valve.

11. The conduit assembly of claim 8 additionally comprising a collar for releasably securing said connector to said fitment.

12. The conduit assembly of claim 11 wherein said collar is arranged to be snap-fit over said fitment and connector.

13. The conduit assembly of claim 11 wherein said collar is arranged to be threadedly engaged over said fitment and connector.

14. The conduit assembly of claim 8 wherein said package is in the form of a bag-in-box, wherein said hollow body comprises a flexible bag.

* * * * *